United States Patent [19]

Mineo et al.

[11] Patent Number: 4,677,730

[45] Date of Patent: Jul. 7, 1987

[54] METHOD OF ATTACHING PRESS-IN FLANGE TO DRUM OR LIKE CONTAINER

[75] Inventors: Masanari Mineo; Kinji Mineo, both of Arakawa, Japan

[73] Assignee: Yamato Iron Works Co., Ltd., Tokyo, Japan

[21] Appl. No.: 854,078

[22] Filed: Apr. 17, 1986

Related U.S. Application Data

[63] Continuation of Ser. No. 609,951, May 14, 1984, abandoned.

[30] Foreign Application Priority Data

May 12, 1983 [JP] Japan ..... 58-83741

[51] Int. Cl.[4] ..... B23D 11/00; B65D 41/04; B21D 51/46

[52] U.S. Cl. ..... 29/512; 220/288; 285/202; 413/9; 413/34

[58] Field of Search ..... 413/9, 34; 220/288; 29/512; 285/202

[56] References Cited

U.S. PATENT DOCUMENTS 2,445,802 1/1948 Robinson ..... 285/202

3,124,267 3/1964 Cetrone ..... 285/202 X

FOREIGN PATENT DOCUMENTS 733189 10/1932 France ..... 285/202

*Primary Examiner*—Howard N. Goldberg
*Assistant Examiner*—Irene Graves Golabi
*Attorney, Agent, or Firm*—Armstrong, Nikaido, Marmelstein & Kubovcik

[57] ABSTRACT

A method of attaching a press-in flange having a tubular portion and a horizontal portion to a tubular mouthpiece of the top plate of a drum or like container by providing a gasket between the tubular portion of the flange and an upward annular projection on the flange horizontal portion, forcing the flange having the gasket thereon into the tubular mouthpiece from below, and outwardly bending the upper end of the flange tubular portion to hold the upper end folded over the upper end of the mouthpiece while bringing the annular projection into intimate contact with the inner surface of a curved portion between the upper and lower ends of the mouthpiece to confine the gasket in a space defined by the annular projection, the curved portion, the lower end of the tubular portion and part of the horizontal portion.

4 Claims, 11 Drawing Figures

METHOD OF ATTACHING PRESS-IN FLANGE TO DRUM OR LIKE CONTAINER

This application is a continuation of application Ser. No. 609,951 filed May 14, 1984 now abandoned.

BACKGROUND OF THE INVENTION

The present invention relates to a method of attaching a press-in flange to drums and like containers.

Conventionally a press-in flange is attached to a tubular mouthpiece on the top plate of a drum by fitting an annular gasket around the tubular portion of the flange, and forcing the flange into the mouthpiece of the top plate from below to fold the upper end of the tubular portion of the flange over the upper end of the mouthpiece and fit the outer periphery of a polygonal horizontal portion of the flange into pressing contact with the inner peripheral surface of a similarly polygonal skirt portion of the mouthpiece at the lower end thereof. However, when preparation of the flange or the top plate involves errors or if the horizontal portion is fitted in the skirt portion as displaced therefrom, a clearance occurs between the outer periphery of the horizontal portion and the skirt portion. Further when the gasket has great hardness or is confined in too small a space, the gasket pushes up the top plate to produce a clearance between the outer periphery of the horizontal portion and the skirt portion. Accordingly the contents of the drum seep through such a clearance to attack the gasket and to permit the gasket to partly come out through the clearance when swelling, impairing the sealing function of the gasket and resulting in a leak.

SUMMARY OF THE INVENTION

The present invention, which has overcome the above problem, provides a method of attaching a press-in flange having a tubular portion and a horizontal portion to a tubular mouthpiece on the top plate of a drum or like container. The method is characterized by providing a gasket between the tubular portion of the flange and an upward annular projection on the flange horizontal portion, forcing the flange having the gasket thereon into the tubular mouthpiece from below, and outwardly bending the upper end of the flange tubular portion to hold the upper end over the upper end of the mouthpiece while bringing the annular projection into intimate contact with the inner surface of a curved portion of the mouthpiece between the upper and lower ends thereof to confine the gasket in a space defined by the annular projection, the curved portion, the lower end of the tubular portion and part of the horizontal portion.

According to the method of the invention, the annular projection on the flange is effectively held in intimate contact with the curved portion of the tubular mouthpiece of the top plate, almost completely holding the gasket out of contact with the contents of the container to greatly eliminate the likelihood that the gasket will be attacked by the contents. Furthermore, the gasket, which is reliably confined in the space, is totally uhlikely to come out from the space even if swollen by the contents and therefore retains its proper sealing function to effectively preclude leakage of the contents. Thus the foregoing problem can be overcome.

The present invention will be described in greater detail with reference to the accompanying drawings.

DESCRIPTION OF THE PREFERRED EMBODIMENTS

Figure 1:
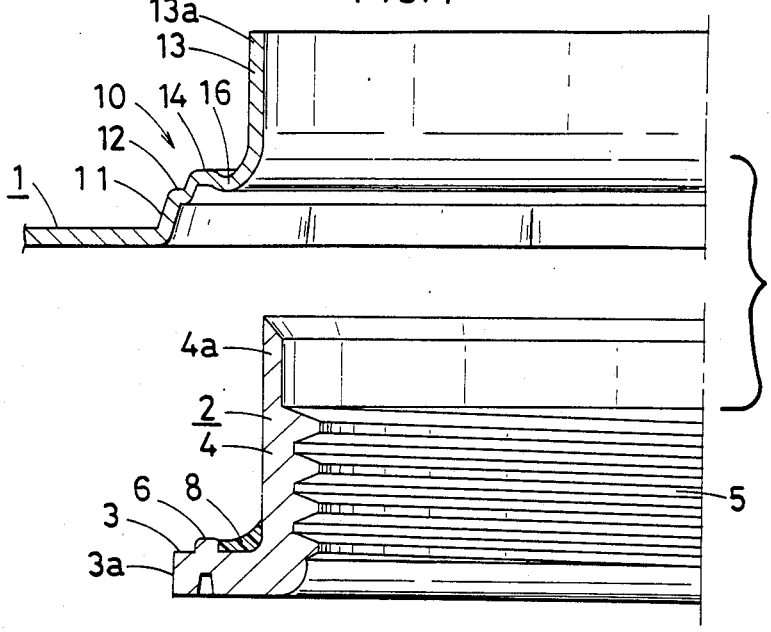
FIG. 1 is a fragmentary view in vertical section showing an embodiment of the invention, and more specifically the top plate of a drum and a press-in flange before being attached thereto.
Figure 2:
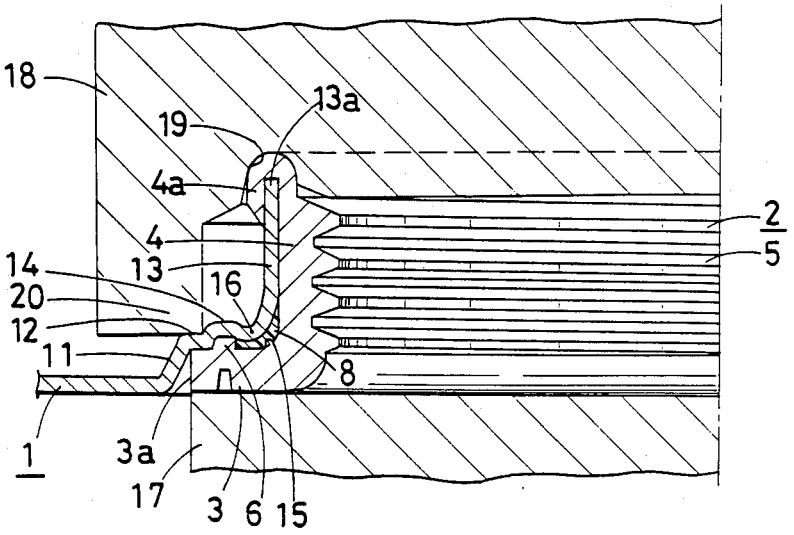
FIG. 2 is a fragmentary view in vertical section showing the flange of FIG. 1 as attached to the top plate by a press.

An embodiment of the present invention will be described first with reference to FIGS. 1 and 2. A pressin flange 2 for a drum comprises a horizontal portion 3 having a polygonal periperal edge 3*a*. An upward annular projection 6 is formed on the horizontal portion 3 proximate the midportion of the width thereof as by press work. The flange has a tubular portion 4 internally threaded as at 5. A gasket 8 is provided between the annular projection 6 and the tubular portion 4. Preferably the gasket 8 is a silicone rubber gasket which is liquid before application and which solidifies into an elastic body after application. The gasket is formed by lining. The lining gasket has the advantage of being very easy to install, while the liquid gasket material is prevented from flowing out by the presence of the annular projection 6 during lining. A sealing compound, which is powdery when to be applied, is similarly advantageous to use as the gasket 8. Also useful as the gasket 8 are usual annular gaskets made of rubber, synthetic resin or asbestos and having a circular or rectangular cross section.

On the other hand, the top plate 1 is provided with a tubular mouthpiece 10 which comprises a skirt portion 11 polygonal in horizontal section and formed integrally with the top plate 1 at a specified location, an annular stepped portion 12 extending horizontally inward from the upper edge of the skirt portion 11 and a tubular upstanding portion 13 made integral with the inner edge of the stepped portion 12 by a curved portion 14. The flange 2 having the gasket 8 thereon is forced into the tubular mouthpiece 10 from below. As seen in FIG. 2, the assembly of the top plate 1 and the flange 2 is placed on a lower die 17 of a press, and an upper die 18 having a crimping groove 19 is then lowered to outwardly bend the upper end 4*a* of the tubular portion 4 of the flange 2 by the grooved portion 19 and to hold the upper end 4*a* folded over the upper end 13*a* of the upstanding portion 13. At the same time, an annular pressing projection 20 of the upper die 18 presses the annular stepped portion 12 from above to bring the annular projection 6 into intimate contact with the curved portion 14 and to thereby confine the gasket 8 in a space 15 defined by the annular projection 6, the curved portion 14, the lower end of the tubular portion 4 and part of the horizontal portion 3.

With the present embodiment, the curved portion 14 of the mouthpiece 10 is pre-formed with an annular recessed portion 16 extending into or integral with the upstanding portion 13. Accordingly, when the flange 2 is forced into the mouthpiece 10 of the top plate 1, the annular recessed portion 16 is fitted in between the annular projection 6 and the tubular portion 4 of the flange 2. The annular projection 6 is therefore covered with the upwardly bulging curved portion 14 from above and held in intimate contact with the curved portion 14 very effectively to assure outstanding air- or liquid-tightness. Furthermore, the fitted-in recessed portion 16 serves to reduce the volume of the space 15 by a corresponding amount and affords the advantage of decreasing the amount of gasket 8 needed.

The annular pressing projection 20 of the upper die 18 can be omitted in some case. In this case, the annular projection 6 is brought into intimate contact with the curved portion 14 by the clamping force of the upper and lower dies 18, 17 which is applied for folding the upper end 4*a* of the flange tubular portion 4 over the upper end 13*a* of the mouthpiece upstanding portion 13 for crimping.

Figure 3:
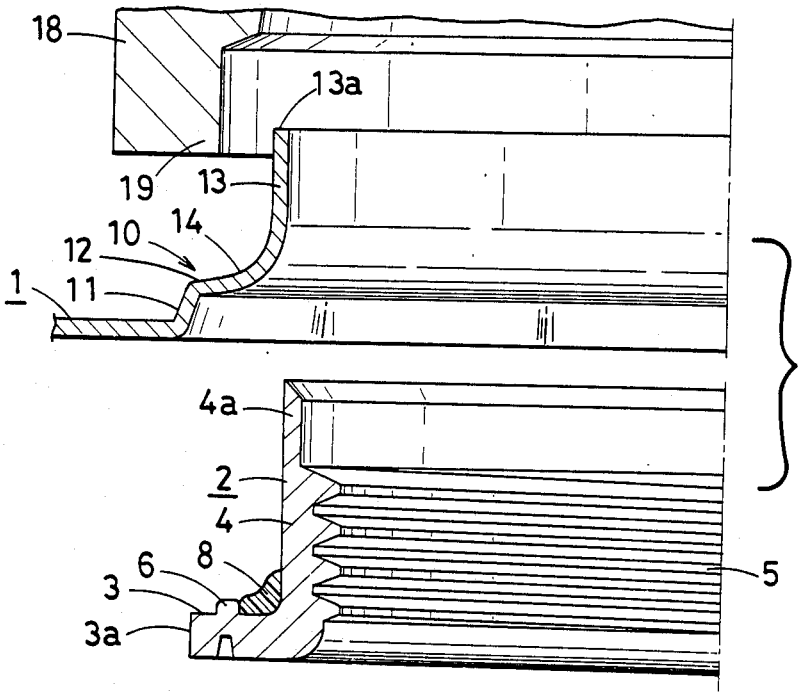
FIG. 3 is a fragmentary view in vertical section showing another embodiment of the invention, and more specifically the top plate of a drum, a flange which is to be attached thereto and an upper die of the press.
Figure 4:
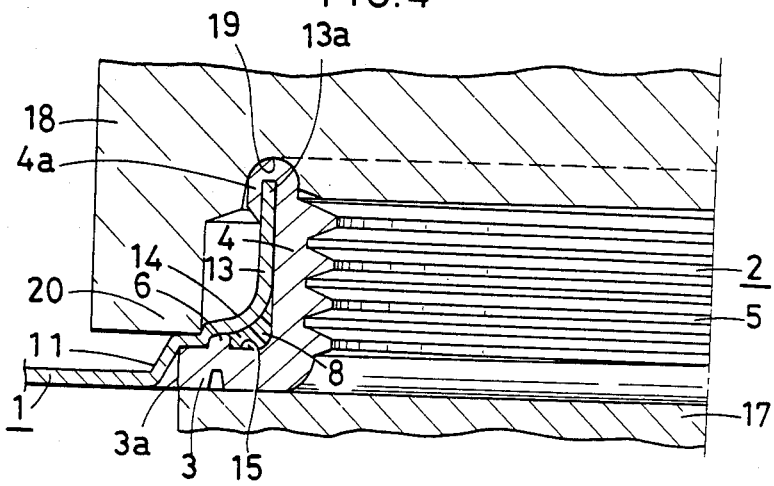
FIG. 4 is a fragmentary view in vertical section showing the flange of FIG. 3 as attached to the top plate by the press.
Figure 5:
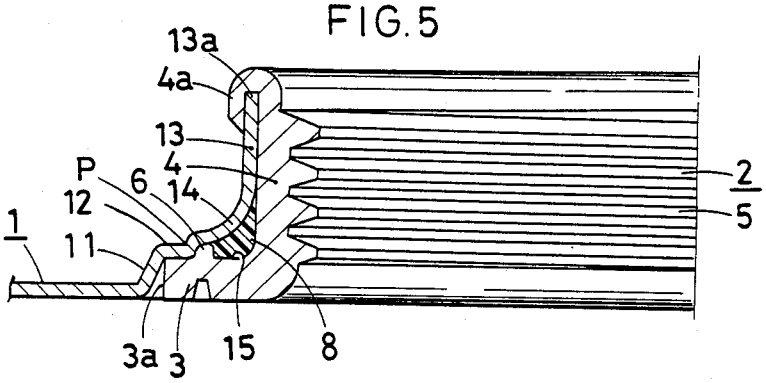
FIG. 5 is a fragmentary view in vertical section showing the flange-and-top plate assembly of FIG. 4 as released from the press.

FIGS. 3 to 5 show another embodiment of the invention.

In this embodiment, the curved portion 14 of the mouthpiece 10 is not pre-formed with the annular recessed portion 16. When the upper end 4*a* of the tubular portion 4 of the flange 2 is folded over the upper end 13*a* of the upstanding portion 13 of the mouthpiece 10 for crimping, the curved portion 14 is pressed from above and deformed at the outer side of the annular projection 6 in the vicinity thereof by the annular pressing projection 20 of the upper die 18, whereby the annular projection 6 is brought into intimate contact with the inner surface of the curved portion 14. Consequently, the space 15 for accommodating the gasket 8 is larger than in the embodiment of FIG. 2. The bent portion P (FIG. 5) formed between the annular stepped portion 12 and the curved portion 14 by the deforming pressure of the annular pressing projection 20 of the upper die 18 always acts to revert to its original curved state by virtue of the springback of the top plate material, with the result that at opposite sides of the bent portion P, the outer peripheral edge of the annular stepped portion 12 is firmly pressed against the outer peripheral edge of the horizontal portion 3, with the inner surface of the curved portion 14 similarly pressed against the upper end outer edge of the annular projection 6. This assures further improved air- or liquid-tightness.

According to the foregoing two embodiments, the annular projection 6 is formed on the horizontal portion 3 of the flange 2 by press work, and an annular groove corresponding to the annular projection 6 is formed in the rear side of the horizontal portion 3. However, the annular projection 6 only may be formed without the annular groove, by pressing the horizontal portion 3 from above. The annular projection 6 may be formed on the upper side of the horizontal portion 3 by cutting the material instead of resorting to press work.

Figure 6:
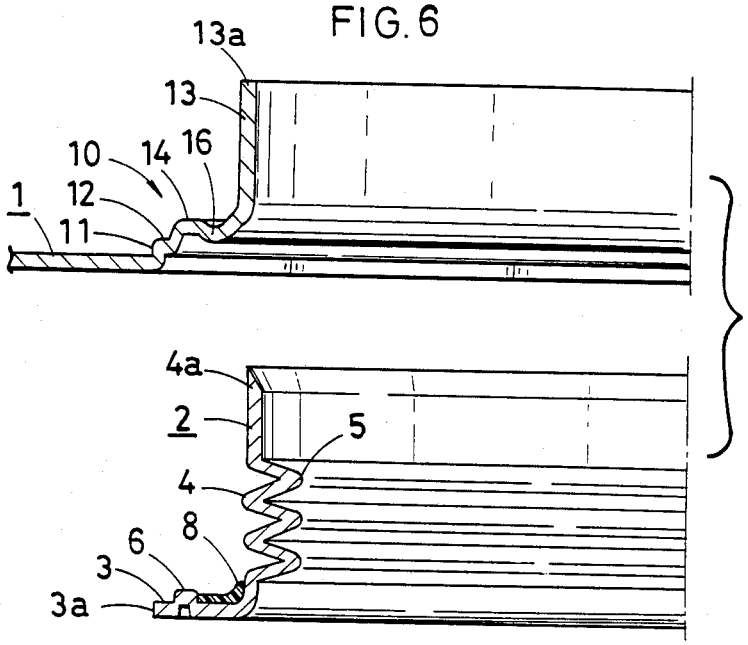
FIG. 6 is a fragmentary view in vertical section showing another embodiment of the invention, and more particularly the top plate of a drum and a flange which is to be attached thereto.
Figure 7:
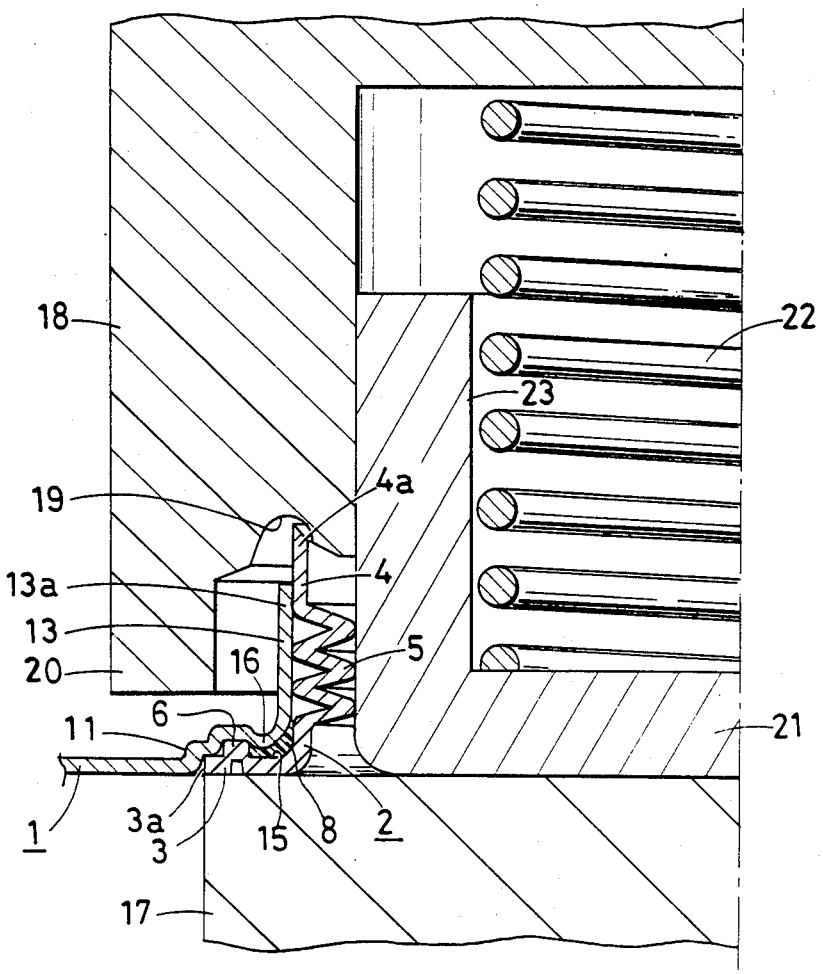
FIG. 7 is a fragmentary view in vertical section showing the flange of FIG. 6 while it is being attached to the top plate by the press.
Figure 8:
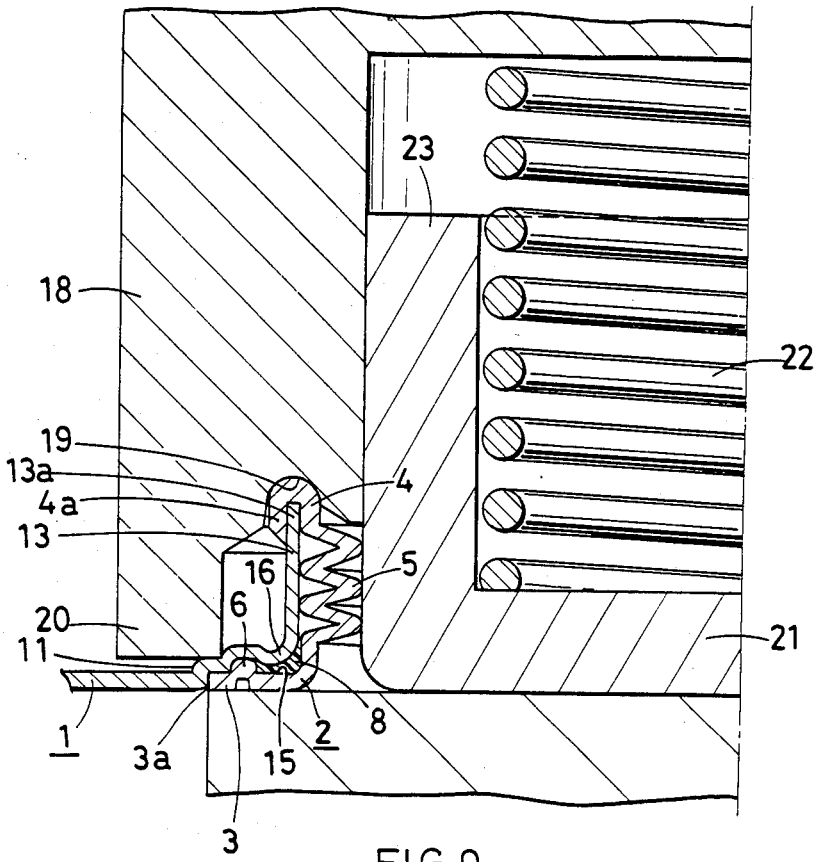
FIG. 8 is a fragmentary view in vertical section showing the flange of FIG. 7 as attached to the top plate.

FIGS. 6 to 8 show another embodiment of the invention.

According to this embodiment, the flange 2 is made by blanking out a circular workpiece from a sheet having a relatively small thickness, for example, of 1.4 to 1.8 mm, forming the tubular portion 4 having a wall thickness of 1.2 to 1.6 mm by drawing, forming the annular projection 6 on the horizontal portion 3 and thereafter internally threading the tubular portion 4 as at 5 by rolling. After plating the flange 2, the gasket 8 is provided between the annular projection 6 and the lower end of the tubular portion 4. The flange 2 thus prepared from a sheet material by press work is easy, inexpensive and therefore advantageous to make. The internally threaded part 5, which is formed by rolling, is smooth-surfaced and retains the plating or a coating thereon effectively. Insofar as the tubular portion 4 formed by drawing has the above-mentioned wall thickness, sufficient strength is available when the flange 2 is attached to the tubular mouthpiece 10 of the top plate 1. Since the corner between the tubular portion 4 and the horizontal portion 3 serves as a support point when the upper end 4*a* of the tubular portion 4 of the flange 2 is folded over the upper end of the mouthpiece 10 for crimping, the portions 3 and 4 are preferably at a right angle with each other to prevent the tubular portion 4 from buckling during crimping.

The upper die 18 to be used for this embodiment is internally provided with a hollow cylindrical guide member 21 having a bottom for preventing the flange from buckling, movable upward and downward and biased downward by a spring 22. As the upper die 18 moves down to attach the flange 2 to the tubular mouthpiece 10 of the top plate 1, the guide member 21 first advances into the flange 2 as shown in FIG. 7. When the upper die 18 further moves down, the guide member 21 comes into contact with the lower die 17, whereupon the spring 22 is compressed, allowing the upper die 18 to further descend. Consequently the upper end 4*a* of the flange tubular portion 4 is outwardly bent and folded over the upper end 13*a* of the mouthpiece 10, along the inner surface of the upper die 18 defining the crimping groove 19 as seen in FIG. 8. Because the inner ridges of the internal threaded part 5 of the flange 2 are positioned along the peripheral wall 23 of the guide member 21 at this time, the tubular portion 4 of the flange 2 will not buckle.

Figure 9:
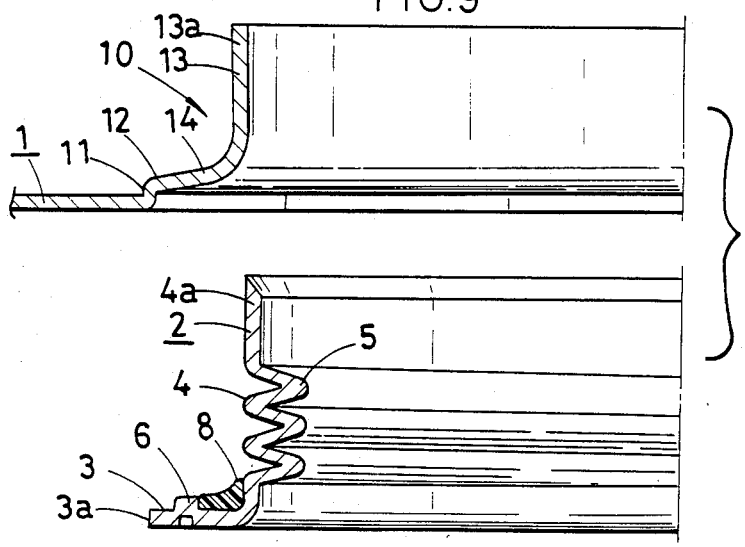
FIG. 9 is a fragmentary view in vertical section showing another embodiment of the invention, and more particularly the top plate of a drum and a flange which is to be attached thereto.
Figure 10:
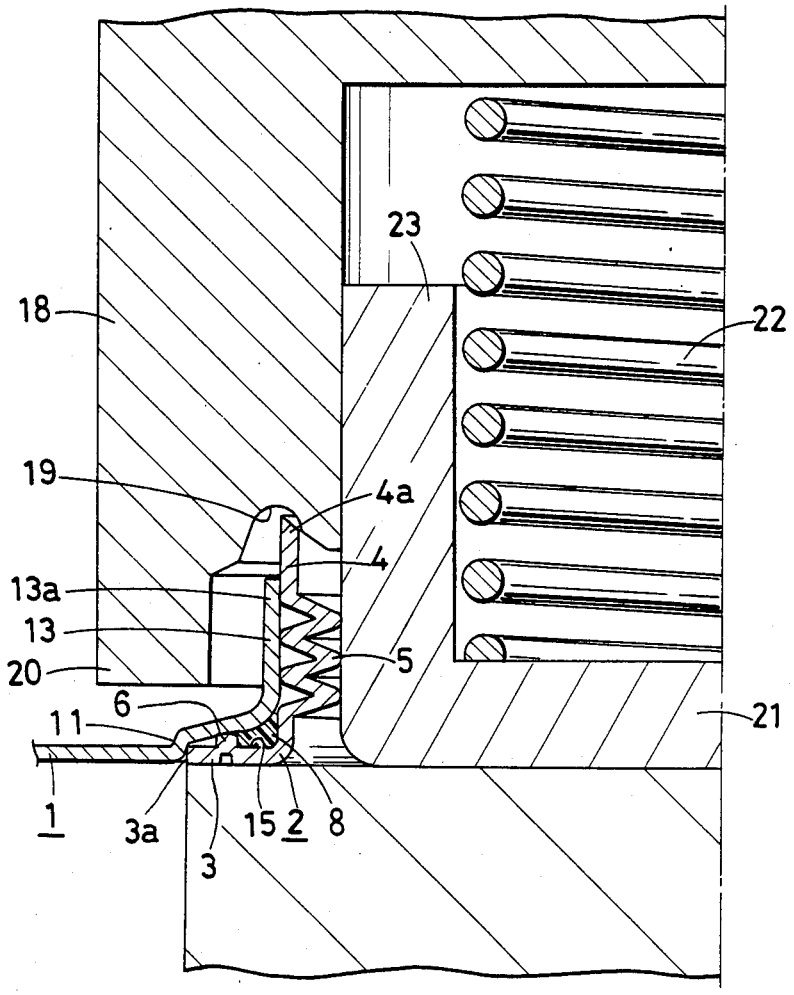
FIG. 10 is a fragmentary view in vertical section showing the flange of FIG. 9 while it is being attached to the top plate by the press.
Figure 11:
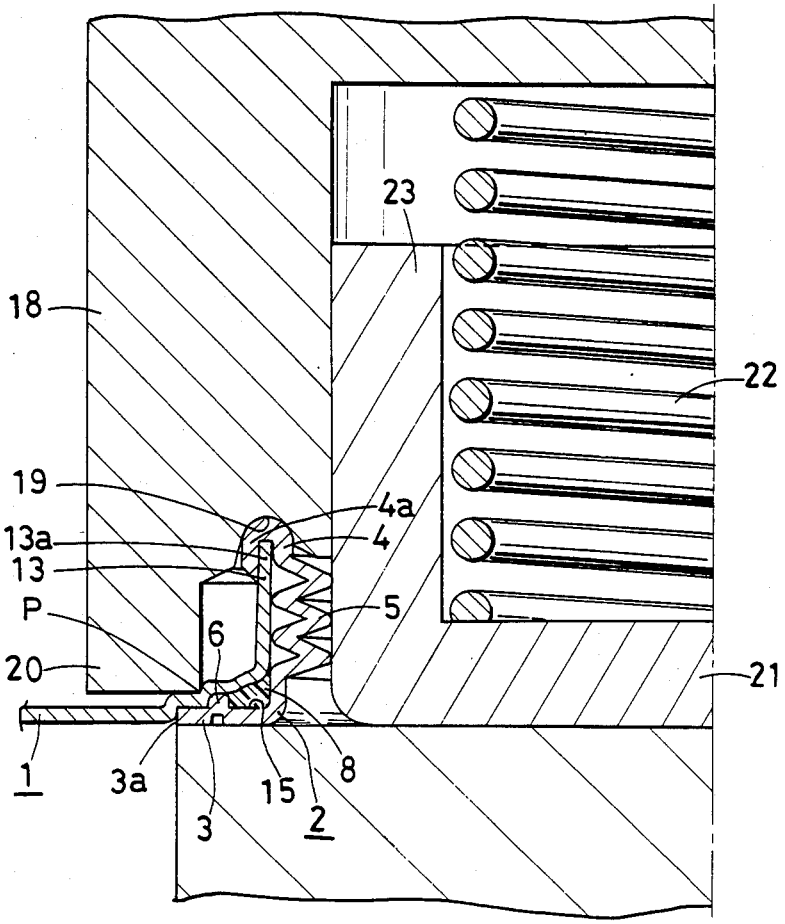
FIG. 11 is a fragmentary view in vertical section showing the flange of FIG. 10 as attached to the top plate.

FIGS. 9 to 11 show an embodiment wherein the curved portion 14 of the mouthpiece 10 is not provided with the pre-formed annular recessed portion 16.

When the flange 2 is to be attached to the tubular mouthpiece 10 of the top plate 1 according to this embodiment, the annular pressing projection 20 of the upper die 18 presses and deforms the curved portion 14 of the mouthpiece 10 at the outer side of the annular projection 6 in the vicinity thereof as is the case with the embodiment shown in FIGS. 3 to 5. The guide member 21, which advances into the flange 2 at this time, prevents the flange tubular portion 4 from buckling.

For easy crimping, it is desirable that the upper end 4a of the flange tubular portion 4 be slightly bent to a curved form when the internally threaded part 5 is formed as by rolling.

The press-in flange attaching method of the present invention, which is useful for drums, is also applicable to containers of like type such as gallon cans.

What is claimed is:

1. An improved method of attaching a press-in flange 2 comprising a tubular portion 4 having an internally threaded part 5 and a horizontal portion 3 extending outward from the lower end of the tubular portion 4 and having a polygonal edge 3*a*, to a drum by fitting an annular gasket 8 around the tubular portion 4 of the flange 2, forcing the flange 2 having the gasket thereon from below into a tubular mouthpiece 10 comprising a shirt portion 11 integral with the top plate 1 and polygonal in horizontal section, an annular stepped portion 12 extending horizontally inward from the upper edge of the skirt portion 11 and a tubular upstanding portion 13 made integral with the inner edge of the stepped portion 12 through a curved portion 14, and outwardly bending the upper end 4*a* of the tubular portion 4 of the flange 2 to hold the upper end 4*a* folded over the upper end 13*a* of the upstanding portion 13 while bringing the polygonal peripheral edge 3*a* of the horizontal portion 3 of the flange 2 into intimate contact with the inner surface of the skirt portion 11 of the tubular mouthpiece 10, wherein the improvement comprises:

(a) providing an upward annular projection 6 on the horizontal portion 3 of the flange 2 substantially at the midportion of its width;

(b) fitting said annular gasket 8 in between said annular projection 6 and the lower end of the tubular portion 4 before forcing the flange 2 into the tubular mouthpiece 10; and (c) bringing the annular projection 6 of the flange 2 into intimate contact with the inner surface of the curved portion 14 of the tubular portion 10 to thereby confine the gasket 8 into the space defined by the annular projection 6, the curved portion 14, the lower end of the tubular portion 4 and part of the horizontal portion 3, when the flange 2 is forced into the tubular mouthpiece 10 of the top plate 1 and fixed thereto.

2. A method as defined in claim 1 whereint he curved portion 14 of the mouthpiece 10 is pre-formed with an annular recessed portion 16 integral with the upstanding portion 13 and along the same, and when the flange 2 is forced into the mouthpiece 10 of the top plate 1, the annular recessed portion 16 is fitted in between the annular projection 6 and the tubular portion 4 from above.

3. A method as defined in claim 1 wherein when the upper end 4*a* of the tubular portion 4 of the flange 2 is folded over the upper end 13*a* of the upstanding portion 13 of the mouthpiece 10, the curve portion 14 of the mouthpiece 10 is pressed from above and deformed at an outer side of the annular projection 6 in the vicinity thereof by an annular pressing projection 20 of an upper die 18 of a press, whereby the stepped portion 12 of the tubular upstanding portion 13 is brought into intimate contact with the outer peripheral edge of the flange horizontal portion 3 and the annular projection 6 is brought into intimate contact with the inner surface of the curved portion 14.

4. A method as defined in claim 1 wherein the gasket 8 is a member selected from the group consisting of lining gasket, sealing compound and annular gasket made of rubber, synthetic resin or asbestos and having a circular or rectangular cross section.

* * * * *